US007204116B2

(12) United States Patent
Heringshausen

(10) Patent No.: US 7,204,116 B2
(45) Date of Patent: Apr. 17, 2007

(54) FLANGING APPARATUS FOR ROLLER HEMMING

(75) Inventor: Michael D. Heringshausen, Grand Blanc, MI (US)

(73) Assignee: Tesco Engineering, Inc., Auburn Hills, MI (US)

( * ) Notice: Subject to any disclaimer, the term of this patent is extended or adjusted under 35 U.S.C. 154(b) by 90 days.

(21) Appl. No.: 11/174,898

(22) Filed: Jul. 5, 2005

(65) Prior Publication Data

US 2007/0006627 A1 Jan. 11, 2007

(51) Int. Cl.
*B21D 7/02* (2006.01)
*B21D 11/00* (2006.01)
*B23P 11/00* (2006.01)

(52) U.S. Cl. ..... 72/214; 72/306; 29/243.58

(58) Field of Classification Search ..... 72/210, 72/214, 220; 29/243.5, 243.57, 243.58
See application file for complete search history.

(56) References Cited

U.S. PATENT DOCUMENTS 6,425,277 B2 * 7/2002 Wiens ..... 72/210
6,804,981 B1 * 10/2004 Maier ..... 72/306

* cited by examiner

*Primary Examiner*—Lowell A. Larson
*Assistant Examiner*—Teresa M. Bonk
(74) *Attorney, Agent, or Firm*—Fildes & Outland, P.C.

(57) ABSTRACT

A flanging apparatus for use in roller hemming with a robotic hemming roller and a roller hemming anvil having a peripherally disposed hemming surface includes a tool insert having a flanging surface including a peripherally disposed flanging edge of a shape generally corresponding to a shape of the hemming surface of the hemming anvil. The flanging edge is set at an angle for flanging or pre-bending an outer metal panel used to form a closure panel. The insert is adapted to mount relative to the roller hemming anvil and the outer panel. The outer panel is flanged against the tool insert flanging surface using the hemming roller. Thereafter the tool insert is removable to allow the hemming roller to finish hem together an inner metal panel disposedly nested on the flanged outer panel.

9 Claims, 3 Drawing Sheets

FLANGING APPARATUS FOR ROLLER HEMMING

TECHNICAL FIELD

This invention relates to edge hemming of nested metal panels to form vehicle closures and more particularly to robotic roller hemming of metal panels to form vehicle doors, decklids, hoods, liftgates and the like.

BACKGROUND OF THE INVENTION

It is known in the art relating to large scale production hemming of nested metal panels to form vehicle closures i.e., doors, decklids, hoods, liftgates and the like, to receive an outer metal panel, having its peripheral edge flanged or pre-bent to a set angle ready for hemming, on a hemming anvil or die. An inner panel is nested on the outer flanged panel and the pre-bent peripheral edge of the outer panel is hemmed over an edge of the inner panel to form the closure panel.

Conventional pre-bending or flanging the peripheral edge of the outer panel requires forming of the outer metal panel apart from the hemming operation. It would be desirable to combine the pre-bending or flanging of the peripheral edge of the outer panel at the same station and with the same hemming roller as used for the roller hemming of the nested metal panels.

SUMMARY OF THE INVENTION

The present invention provides a flanging apparatus cooperable with a roller hemming anvil or die which can be used to pre-bend or flange an outer metal panel at the same station and with the same hemming roller used for roller hemming nested inner and outer metal panels together.

More specifically a flanging apparatus for use in roller hemming with a robotic hemming roller and a roller hemming anvil having a peripherally disposed hemming surface includes a tool insert having a flanging surface and a mounting surface. The flanging surface has a peripherally disposed flanging edge of a shape generally corresponding to a shape of the hemming surface of the hemming anvil. The flanging edge is set at an angle for flanging or pre-bending an outer metal panel used to form a closure panel. The mounting surface of the insert is adapted to mount the insert relative to the roller hemming anvil and the outer panel. In use the tool insert is mountable on the outer panel deposited on the hemming anvil. The outer panel is flanged against the tool insert flanging surface using the hemming roller. Thereafter the tool insert is removable to allow the hemming roller to finish hem together an inner metal panel disposedly nested on the flanged outer panel.

The tool insert may include a locator of known mechanical, electrical and/or optical locator means for locating the tool insert relative to the hemming anvil. The tool insert may comprise a plurality of cooperable inter-connecting or fitting sections. At least one crossmember assembly may be provided for containing tool insert sections in an operational disposition. Preferably the tool insert is constructed of metal material.

These and other features and advantages of the invention will be more fully understood from the following detailed description of the invention taken together with the accompanying drawings.

DETAILED DESCRIPTION OF THE INVENTION

Figure 1:
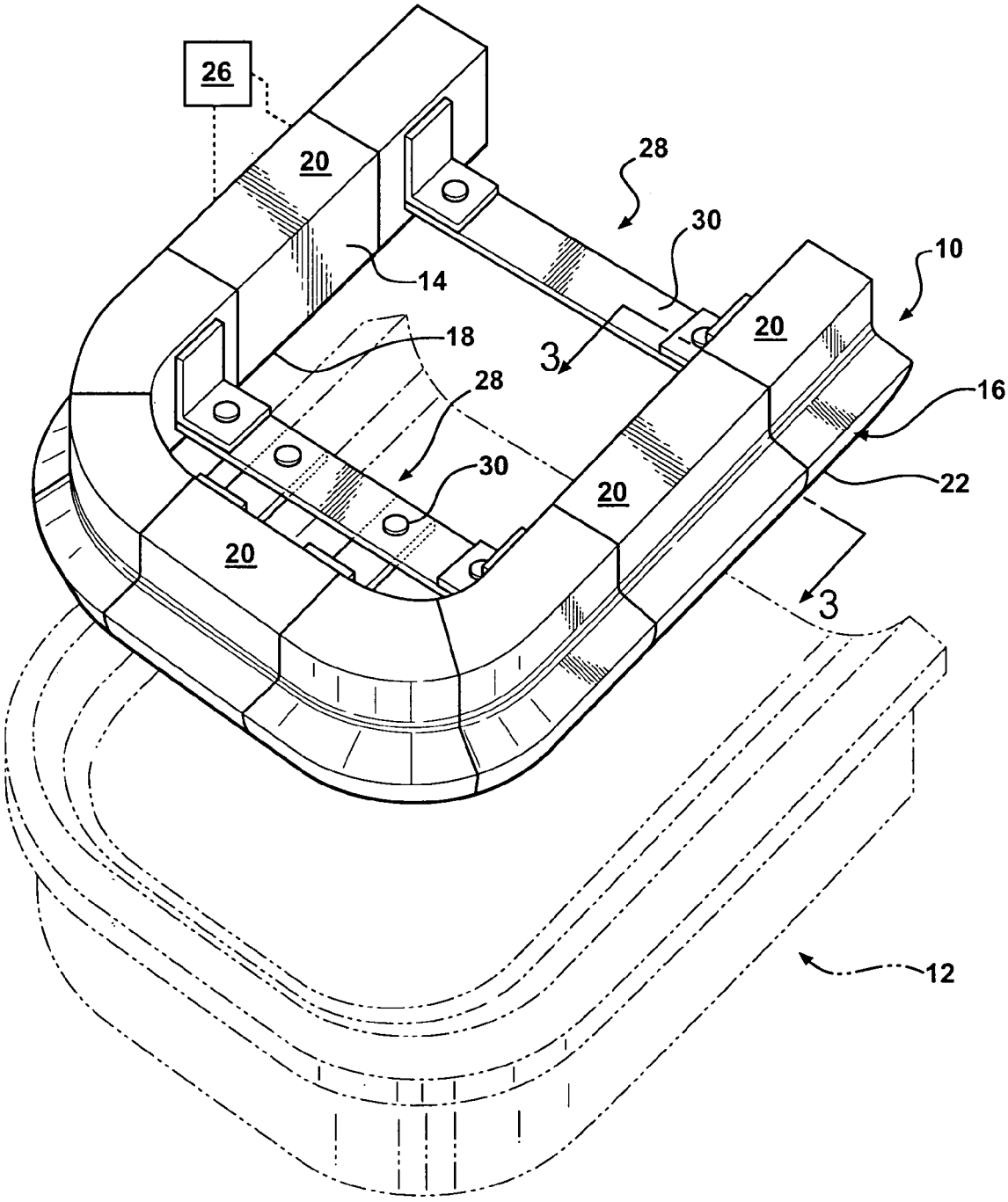
FIG. 1 is a schematic, perspective view of a roller hemming anvil or die and a flanging apparatus for use therewith, constructed in accordance with the present invention.

Referring now to the drawings in detail, numeral 10 generally indicates a flanging apparatus for use with a roller hemming anvil or die 12. Flanging apparatus 10 is used in combination with the roller hemming anvil 12 to flange or pre-bend an outer metal panel of a closure panel assembly at the same station and with the same robotically controlled hemming roller as used for final hemming of the closure panel assembly on the roller hemming anvil 12.

Figure 2:
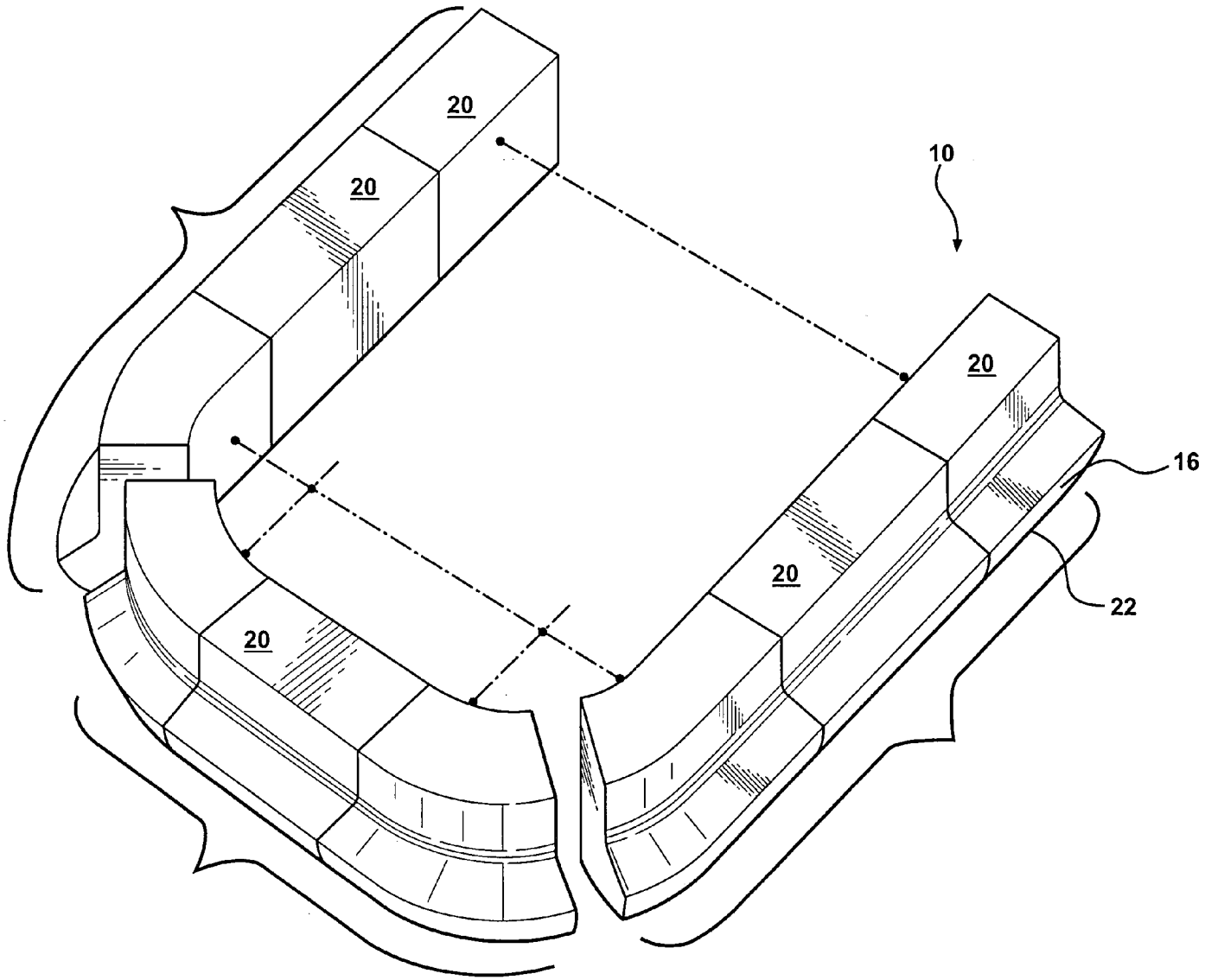
FIG. 2 is a schematic, perspective, partially-in-section view of the flanging apparatus of FIG. 1.

As shown in FIG. 1, the flanging apparatus 10 includes a tool insert 14 having a flanging surface 16 and a mounting surface 18. Flanging apparatus 10 may be of a single-piece construction but is typically formed from sections 20, as seen in FIG. 2, which are pieceable together for easy set-up and for easy removal after flanging as is hereinafter more fully described. Depending on the application, tool insert 14 can be manufactured from KIRKSITE™, aluminum, iron, steel or other suitable material.

The flanging surface 16 of the tool insert 14 has a peripherally disposed flanging edge 22 which generally corresponds to the outline shape of a hemming surface 24 of the hemming anvil 12. The flanging edge 22 is set at an angle for flanging or pre-bending the peripheral edge (PE) of an outer metal panel (P) thereagainst, best seen in FIG. 3. The mounting surface 18 is adapted to mount or position the tool insert 14 on an outer panel (P) which has been deposited or placed on the hemming anvil 12. One or more locators 26 such as known mechanical, electrical or optical locators are used to locate or position the tool insert 12 relative to hemming anvil 12.

With continued reference to FIGS. 1 and 2, a plurality of crossmembers 28 are used to maintain the spatial relationship between the sections 20 which form the insert 14.

Crossmembers 28 are illustrated as rigid elements 30 extending from one side of the insert 14 to the other side of the insert. In the embodiment shown, crossmembers 28 are connected to sections 20 which in part define the insert 14.

Figure 3:
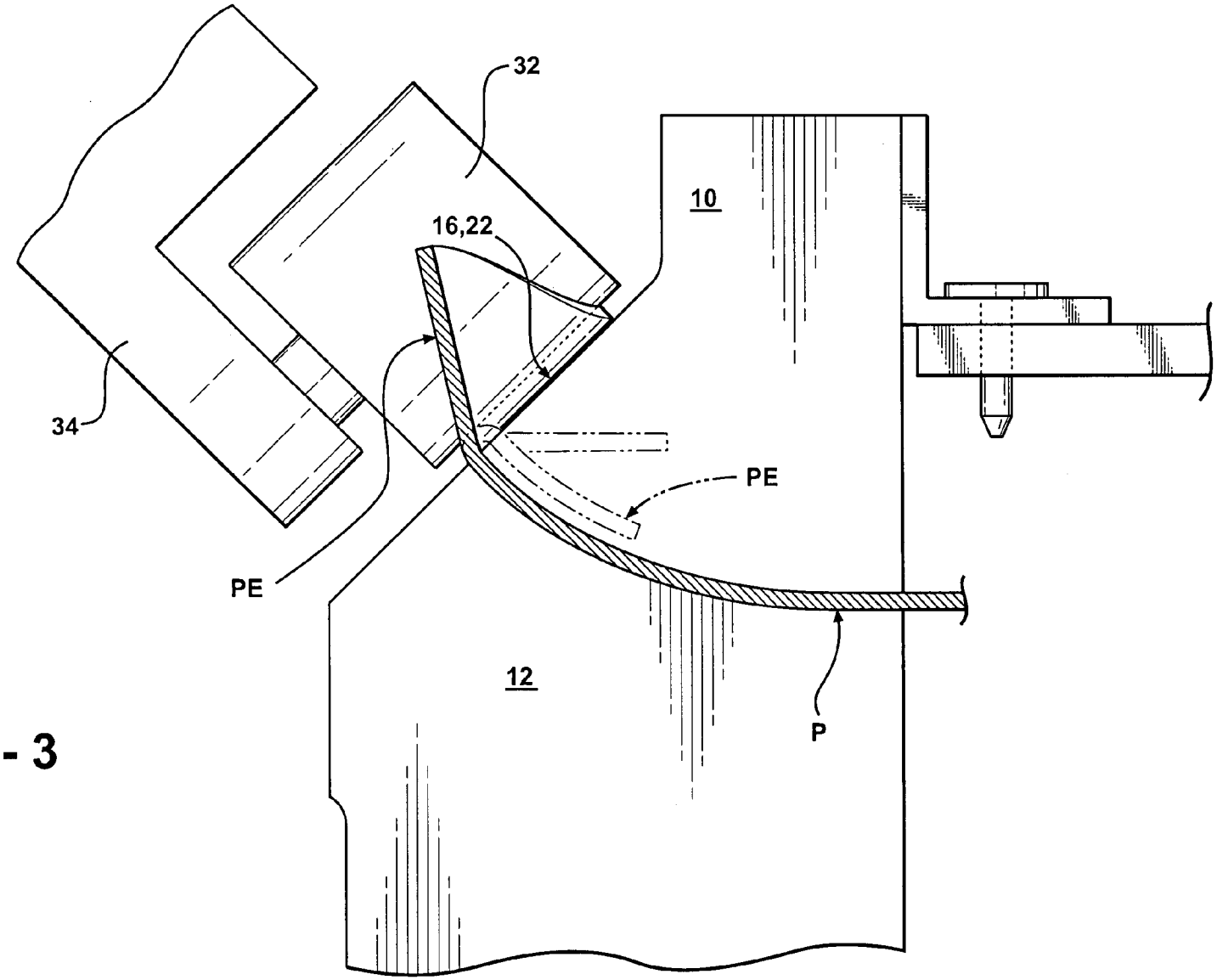
FIG. 3 is a schematic, sectional view of the roller hemming anvil, flanging apparatus and a hemming roller illustrating the disposition of the flanging apparatus about the roller hemming anvil for flange hemming an outer panel on a flanging surface of the flanging apparatus.

With reference to FIG. 3, in operation an outer panel (P) is received on hemming anvil 12. With the aid of locators 26, tool insert 14 is positively positioned on panel (P) relative to the panel and anvil 12. Pressure is applied to hold the panel (P) to the anvil 12 and the panel peripheral edge (PE) can be flanged or pre-bent against tool insert 14. A hem roller 32 controlled by a robot arm 34 is actuated to flange the peripheral edge (PE) of the outer panel (P) against flanging edge 22.

Once the desired angle of the outer panel (P) is achieved, insert 14 is removed from the outer panel and anvil 12. An inner panel (not shown) is then positioned on the flanged outer panel (P). Then the hem roller 32 controlled by robot arm 34 is again actuated to final hem the two panels together to form a closure panel.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A flanging apparatus for use in roller hemming with a robotic hemming roller and a roller hemming anvil having a peripherally disposed hemming surface, the flanging apparatus comprising:

a tool insert having a flanging surface and a mounting surface;

said flanging surface having a peripherally disposed flanging edge of a shape generally corresponding to a shape of said hemming surface of said hemming anvil;

said flanging edge being set at an angle for flanging of an outer metal panel;

said mounting surface being adapted to mount said tool insert relative to said roller hemming anvil;

whereby said tool insert is mountable on an outer panel deposited on said hemming anvil for flanging the outer panel against the tool insert flanging surface using said hemming roller and thereafter said tool insert is removable to allow said hemming roller to finish hem an inner metal panel disposedly nested on the flanged outer panel.

2. The flanging apparatus of claim 1 wherein said tool insert includes a locator for locating said tool insert relative to said hemming anvil.

3. The flanging apparatus of claim 2 wherein said locator is one of a mechanical, electrical and optical locator means.

4. The flanging apparatus of claim 1 wherein said tool insert comprises a plurality of cooperable fittable insert sections.

5. The flanging apparatus of claim 1 including at least one crossmember assembly for containing tool insert sections in an operational disposition.

6. The flanging apparatus of claim 1 wherein said tool insert is constructed of metal material.

7. A method for flanging or pre-bending an outer metal panel of a closure panel, the method comprising the steps of:

providing a hemming anvil;

providing a flanging insert having a flanging surface;

disposing the outer metal panel on said hemming anvil;

sandwiching the outer metal panel between said hemming anvil and flanging insert; and roller hemming a peripheral edge of the outer metal panel against said flanging insert.

8. The method of claim 7 including the step of locating said flanging insert relative to said hemming anvil.

9. The method of claim 7 including the step of removing said flanging insert after flanging the metal panel.

* * * * *